US006315591B2

(12) United States Patent
Oda et al.

(10) Patent No.: US 6,315,591 B2
(45) Date of Patent: Nov. 13, 2001

(54) ELECTRICAL CONNECTOR HAVING AN IMPROVED FEMALE CONTACT

(75) Inventors: Kenzo Oda, Kanagawa; Tetsuya Sagawa, Tokyo, both of (JP)

(73) Assignee: Tyco Electronics, Kanagawa (JP)

( * ) Notice: Subject to any disclaimer, the term of this patent is extended or adjusted under 35 U.S.C. 154(b) by 0 days.

(21) Appl. No.: 09/768,875

(22) Filed: Jan. 24, 2001

(51) Int. Cl.[7] ..... H01R 13/64

(52) U.S. Cl. ..... 439/252; 439/246; 439/382; 439/654

(58) Field of Search ..... 439/252, 246, 439/382, 654, 744, 745, 871, 362

(56) References Cited

U.S. PATENT DOCUMENTS 1,735,731 * 11/1929 Cunningham ..... 439/252
4,666,227 * 5/1987 Galizia et al. ..... 439/252
4,865,558 * 9/1989 Stoner ..... 439/246
4,938,720 * 7/1990 Romak ..... 439/745
5,951,314 * 9/1999 Durand-Cochet et al. ..... 439/252
6,116,942 * 9/2000 Chen et al. ..... 439/362

* cited by examiner

*Primary Examiner*—Tho D. Ta

(57) ABSTRACT

The electrical connector of the present invention includes a female contact 1 having a pair of contact receiving cavities 5*a* and 5*b* at both ends that are capable of accommodating mating contacts A and B. One mating contact A is inserted into and removed from one of the contact receiving cavities 5*a*. A pair of lances 9*a* and 9*b* extend from the female contact away from each other and contact the side walls 16 of the cavity 14 of the housing 10, to allow contact float.

8 Claims, 3 Drawing Sheets

PRIOR ART

ELECTRICAL CONNECTOR HAVING AN IMPROVED FEMALE CONTACT

FIELD OF THE INVENTION

The present invention relates to electrical connectors and more particularly to a female contact which is constructed to receive respective mating contacts at both ends.

BACKGROUND

A female contact is disclosed in Japanese Utility Model Application Kokoku No. H3-13987 and is shown in FIG. 3. In this female contact 100, a contact receiving cavity 102 which accommodates the tab terminal A of a blade type fuse 120 is disposed in one end of a base part 101. A contact receiving cavity 103 which accommodates the tab terminal B of a bus bar is disposed in the other end of the base part 101. A housing 110 supports the female contact 100.

The contact receiving cavity 102 located at one end and the contact receiving cavity 103 located at the other end have the same structure. Each of these contact receiving cavities has an cantilever arm 106 which is folded back to the inside from a top wall 104 via a bent section 105, and a contact section 107 which is stamped out from the base part 101. Here, the tip of each cantilever arm 106 is protected by an antioverstress member 108. The tab terminal A of the blade type fuse 120 is clamped between the cantilever arm 106 and contact section 107 of the contact receiving cavity 102 located at one end, while the tab terminal B of the bus bar is clamped between the cantilever arm 106 and contact section 107 of the contact receiving cavity 103 located at the other end, so that the respective tab terminals are electrically connected to each other.

Here, the tab terminal B of the bus bar located at the second end of the female contact is generally a terminal that is not pulled out again once it has been accommodated in the contact receiving cavity 103. However, the tab terminal A of the blade type fuse 120 located at the first end of the female contact is inserted into and removed from the contact receiving cavity 102 repeatedly.

A problem exists in that the female contact 100 accommodated in the housing 110 is fastened in place so that it does not move with respect to the cavity of the housing 110. As a result, when the tab terminal A of the blade type fuse 120 is inserted into or removed from the female contact 100,it may stub against either the cantilever arm 106, or the anti-overstress member 108 resulting in poor electrical connection.

SUMMARY

Accordingly, the present invention was devised in order to address these problems. An object of the present invention is to provide a female contact that can accommodate mating contacts from both ends. The connector can accommodate a male contact improperly inserted in a misaligned orientation.

The electrical connector of the invention has female contacts each disposed in a housing for receiving mating contacts. A plurality of cavities are formed in the housing each for receiving a respective one of the female contacts. A pair of lances are disposed on and extend outward from each female contact. The pair of lances resiliently engage opposing side walls of a respective one of the cavities such that either lance is compressible to cause a shift of the female contact within the respective cavity upon mating with a misaligned mating contact.

BRIEF DESCRIPTION OF THE DRAWINGS

The invention will now be described by way of example with reference to the accompanying figures of which:

FIG. 1(*a*) is a front view, FIG. 1(*b*) is a right-side view, FIG. 1(*c*) is a sectional view along line 1*c*—1*c* in FIG. 1(*b*), and FIG. 1(*d*) is a plan view.

FIG. 2(*a*) is a plan view, FIG. 2(*b*) is a sectional view along line 2*b*—2*b* in FIG. 2(*a*), and FIG. 2(*c*) is a sectional view along line 2*c*—2*c* in FIG. 2(*a*). In FIGS. 2(*b*) and 2(*c*), the mating contact on the mating side and the main-body side mating contact B disposed on the main body housing are indicated by dotted lines.

DETAILED DESCRIPTION OF THE PREFERRED EMBODIMENT

Figure 1:
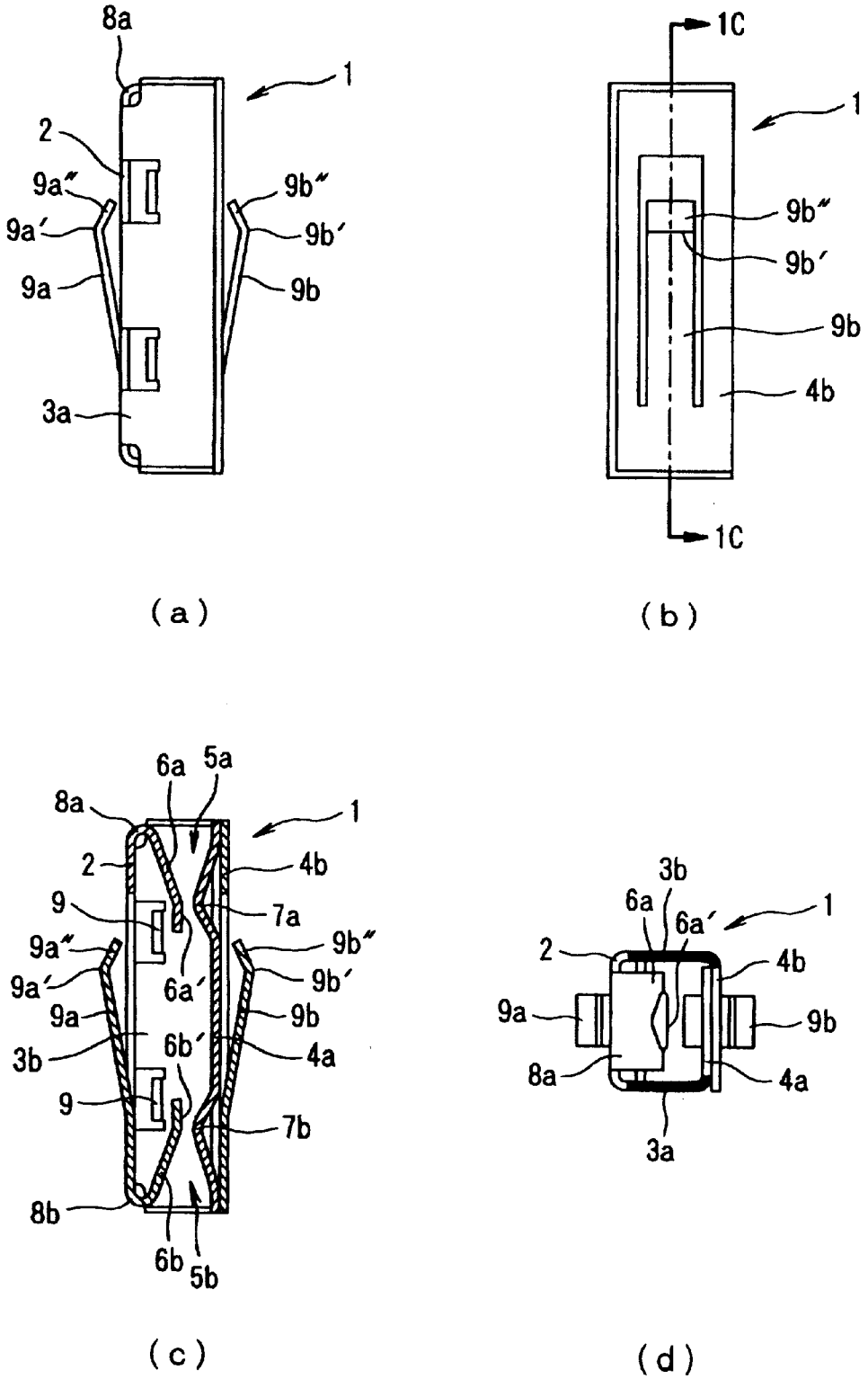
FIG. 1 illustrates the female contact of the present invention.

The female contact of the present invention will now be described in greater detail with reference to the attached figures. In FIG. 1, the female contact 1 is formed in a substantially box shape equipped with a base 2, a pair of side walls 3*a*, 3*b* extending from both sides of the base 2, a lower top wall 4*a* and an upper top wall 4*b* that are bent from the respective side walls 3*a* and 3*b* to overlap each other. The female contact 1 is formed by stamping and bending a metal plate.

Furthermore, the respective ends of the female contact 1 form a pair of contact receiving cavities 5*a* and 5*b* for receiving a male terminal A on the mating side and a male terminal B on the main body side. One contact receiving cavity 5*a* has a cantilever arm 6*a* which is folded back to the inside from one end of the base 2 via a bent section 8*a*, and a protrusion 7*a* which is stamped out from a portion of the lower top wall 4*a* in a position facing the above-mentioned cantilever arm 6*a*. One male terminal A is received between the cantilever arm 6*a* and protrusion 7*a*, and is thus electrically connected to the female contact 1. In this case, the contact surface 6*a*' of the cantilever arm 6*a* elastically contacts the male terminal A, and presses the male terminal A against the protrusion 7*a*. Meanwhile, the other contact receiving cavity 5*b* has a cantilever arm 6*b* which is folded back to the inside from the other end of the base 2 via a bent section 8*b*, and a protrusion 7*b* which is stamped out from a portion of the lower top wall 4*a*. The other male terminal B is received between the cantilever arm 6*b* and protrusion 7*b*, and is thus electrically connected to the female contact 1. In this case, the contact surface 6*b*' of the cantilever arm 6*b* elastically contacts the male terminal B, and presses the male terminal B against the protrusion 7*b*.

Furthermore, a plurality of anti-overstress members 9 that extend between the respective cantilever arms 6*a* and 6*b* of the contact receiving cavities 5*a* and 5*b* and the base 2 are cut out and raised from both side walls 3*a* and 3*b* of the female contact 1. These anti-overstress members 9 contact the cantilever arms 6*a* and 6*b* to prevent excessive deformation. As a result, the generation of an excessive bending stress in the bent parts 8*a* and 8*b* is prevented.

A pair of lances 9*a* and 9*b* extend from the base 2 toward one of the contact receiving cavities. As will be described later, these lances 9*a* and 9*b* elastically contact the inside surfaces of both side walls 16 of the cavity 14 of the housing 10 when the female contact 1 is inserted into this cavity 14.

Contact parts 9*a*' and 9*b*' which contact the inside surfaces of both side walls 16 of the cavity 14 are formed on the free ends of the lances 9*a* and 9*b*. Lead in surfaces 9*a*" and 9*b*" are positioned at the free ends and are bent toward the inside at an angle. These lead in surfaces 9*a*" and 9*b*" facilitate the introduction of the lances 9*a* and 9*b* into the cavity 14 of the housing 10 when the female contact 1 is received inside the cavity 14.

Figure 2:
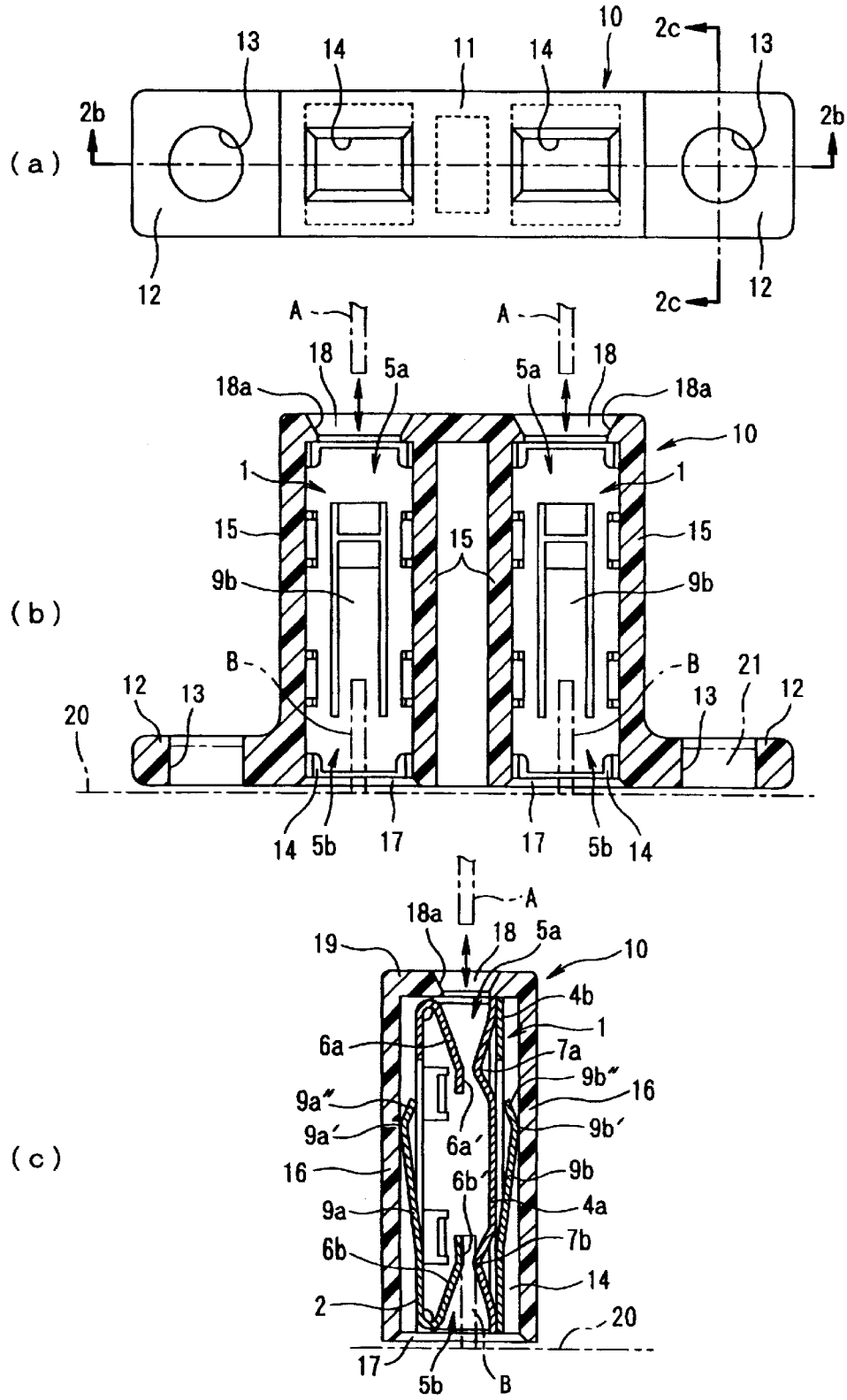
FIG. 2 shows a state in which the female contact shown in FIG. 1 is inserted in a housing.
Figure 3:
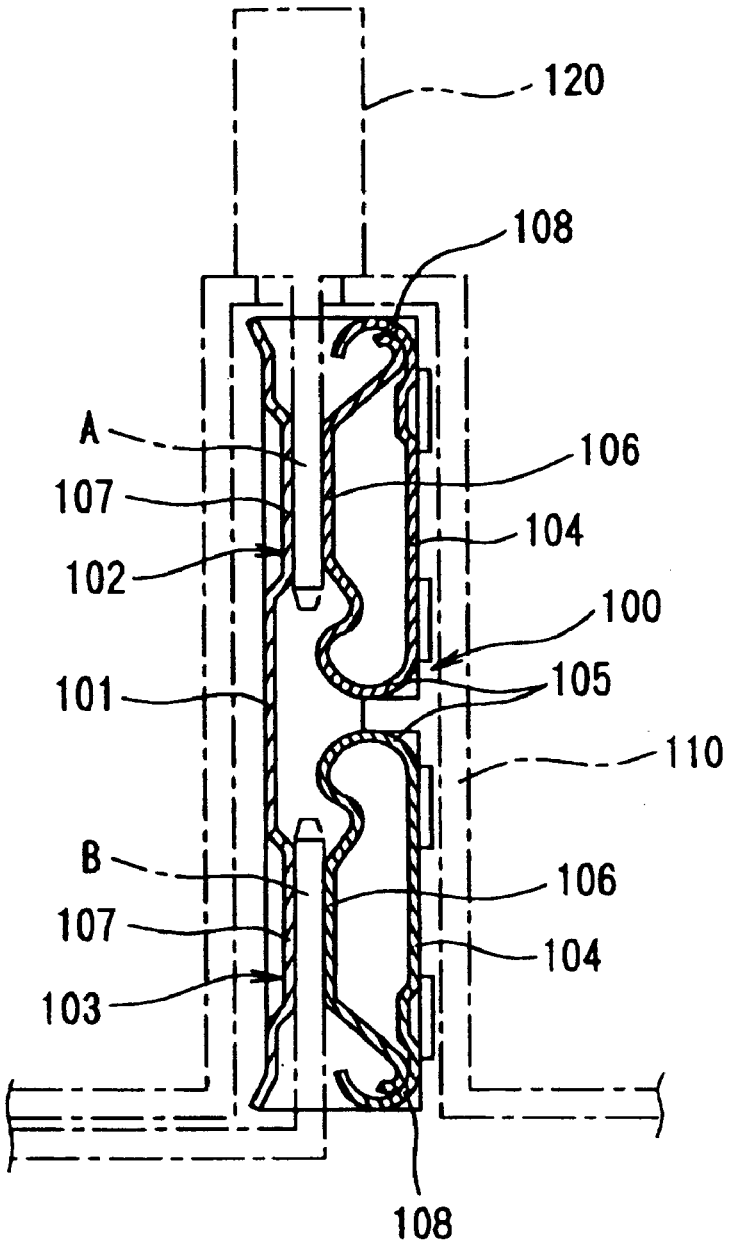
FIG. 3 is a sectional view of a prior art example of a female contact.

As is shown in FIG. 2, the housing 10 for receiving the female contact 1 is equipped with a terminal receiving section 11 that is formed in substantially the shape of a rectangular solid, and a pair of securing sections 12 that protrude from both ends of the terminal receiving section 1. The housing 10 is preferably formed by molding an insulating resin. A plurality of cavities 14 that receive respective female contacts 1 are formed in the terminal receiving section 11. Each of these cavities 14 is defined by a pair of side walls 15, 15 that face each other and a pair of side walls 16, 16 that are perpendicular to the side walls 15, 15. Furthermore, an opening 17 which has substantially the same diameter as the internal diameter of the corresponding cavity 14, is formed at one end of each cavity 14. A passageway 18 which has a diameter that is smaller than the internal diameter of the corresponding cavity 14, and which is used for the insertion and removal of an male terminal A, is formed at the other end of each cavity 14. Tapered surfaces 18*a* which are used to facilitate the insertion of the male terminal A are formed on edges of the passageway 18. Securing openings 13 are formed in the respective securing section 12 for receiving posts 21 that are integrally formed on a main body housing 20.

Next, the method used to accommodate the female contacts 1 in the cavities 14 of the housing 10, and the method used to make electrical connections between the mating contact A and mating contact B via the female contacts 1, will be described with reference to FIG. 2.

The female contacts 1 are inserted into the cavities 14 of the housing 10 with the lances 9*a* and 9*b* facing the side walls 16, 16 of the cavity 14 until the end of the contact receiving cavity 5*a* contacts the inside surface of the wall 19. The lances 9*a* and 9*b* of each female contact 1 first bend inward toward each other as a result of the lead in surfaces 9*a*" and 9*b*" contacting the comer edges of the side walls 16, 16, then, the lances 9*a*' and 9*b*' enter the interior of the cavity 14 while sliding along the inside surfaces of the side walls 16, 16. When the female contact 1 has been fully inserted into the cavity 14, it is secured by the outward elastic force of the lances 9*a* and 9*b* against the side walls 16, 16. The female contact 1 is therefore positioned in the center of the cavity 14.

The mating contacts B extend from the main body housing 20 and are inserted into the other contact receiving cavities 5*b* through the openings 17 to contact the female contact 1. At the same time, the posts 21 on the main body housing 20 are inserted into the securing openings 13 of the housing 10, and are then staked to secure the housing 10 to the main body housing 20. Each male terminal B is received between the cantilever arm 6*b* and protrusion 7*b*. The mating contacts B are therefore preferably permanently fixed within the cavities 14 and electrically connected to the female contacts 1. The posts 21 staked in the housing 10 prevent the female contacts 1 from slipping out of the cavities 14.

The terminals are preferably shipped in a state in which the main body housing 20 is attached to the housing 10. Afterward, as is shown in FIG. 2(*c*), the mating contacts A are inserted into the contact receiving cavities 5*a* of the female contacts 1 as described above. As a result, the mating contacts A are electrically connected to the female contacts 1, and mating contacts B. If necessary, the mating contacts A can be inserted into and removed from the contact receiving cavities 5*a*.

The connector of this invention is designed to prevent contact stubbing. For example, in a case in which the male terminal A is improperly inserted, stubbing is prevented by the tapered surface 18*a*, so that the male terminal A rides along this tapered surface 18*a* and then contacts the protrusion 7*a*. When the male terminal A contacts the protrusion 7*a*, the female contact 1 moves to the right, thus increasing the force on the lance 9*b* contacting the right side wall 16 of the cavity 14, and decreasing the force on the lance 9*a* contacting the left side wall 16. In this state, the male terminal A is clamped between the cantilever arm 6*a* and the protrusion 7*a*. Furthermore, in cases where the male terminal A is shifted to the right, but is inserted without contacting the inclined surface 18*a*, the male terminal A directly contacts the protrusion 7*a*, and is clamped between the cantilever arm 6*a* and protrusion 7*a* such that the force on the lance 9*b* contacting the right side wall 16 of the cavity 14 is increased and the force on the lance 9*a* contacting the left side wall 16 is decreased.

On the other hand, in cases where the male terminal A is inserted while being shifted to the left, the shift to the left is similarly corrected along the tapered surface 18*a*, so that the male terminal A contacts the cantilever arm 6*a*. When the male terminal A contacts the cantilever arm 6*a*, the female contact 1 moves to the left, thus increasing the force on the lance 9*a*, and decreasing the elastic force on the lance 9*b*. In this state, the male terminal A is clamped between the cantilever arm 6*a* and the protrusion 7*a*. Furthermore, in cases where the male terminal A is shifted to the left, but is inserted without contacting the inclined surface 18*a*, the male terminal A directly contacts the cantilever arm 6*a*, and is clamped between the cantilever arm 6*a* and protrusion 7*a* such that the force on the lance 9*a* is increased and the force on the lance 9*b*. Accordingly, even if the male terminal A is inserted while being shifted either to the right or left, the female contact 1 can absorb the shift of this insertion and make an appropriate electrical connection with the male terminal A.

An embodiment of the present invention has been described here, however, the invention is not limited to this embodiment because various alterations are possible and within the spirit of the invention. For example, it would also be possible to have lances 9*a* and 9*b* extend from the base 2 and the upper top wall 4*b* which is located on the side of the female contact 1 receiving the male terminal A. Furthermore, the cantilever arms 6*a*, 6*b* and the contacts A and B lie in parallel planes. The connector may be modified so that the contacts A and B enter at angles to each other. In such a case, the pair of lances 9*a* and 9*b* extend in the direction perpendicular to the contact surface 6*a*' and the male terminal A.

Advantageously, even if the male terminal A that is inserted and removed is inserted while being shifted or misaligned with the contact surface of the cantilever arm, the female contact 1 can absorb the shift or misalignment and make an appropriate electrical connection with the male terminal A. An additional advantage is that when the female contact 1 is accommodated in the cavity 14 of the housing 10, the female contact 1 is positioned so that both ends are supported thus ensuring that the female contact 1 is appropriately centered with respect to the cavity 14.

What is claimed is:

1. An electrical connector comprising:

a housing;

a plurality of cavities formed in the housing each for receiving a respective female contact therein; and, a plurality of female contacts, each disposed within a respective one of said cavities, each female contact comprising a box-shaped member having a pair of lances disposed on and extending outward from opposed external surfaces of the box-shaped member, the pair of lances resiliently engaging opposing side walls of a respective one of the cavities, wherein upon mating of a misaligned mating contact with said female contact either lance is compressible to permit a lateral shift of the female contact within the respective cavity.

2. The electrical connector of claim 1 wherein the lances further comprise lead in surfaces being angled inward toward the box-shaped member.

3. The electrical connector of claim 2 wherein the female contact further comprises a cantilever arm bent from a wall of the box-shaped member into an interior of said box-shaped member at a mating end of the female contact.

4. The electrical connector of claim 3 wherein the female contact further comprises a second cantilever arm bent from a wall of the box-shaped member into an interior of the box-shaped member at a mounting end of the female contact opposite the mating end.

5. The electrical connector of claim 4 wherein the female contact further comprises a protrusion extending into the box-shaped member opposite the cantilever arm.

6. The electrical connector of claim 5 further comprising a second protrusion extending into the box-shaped member opposite the second cantilever arm.

7. The electrical connector of claim 6 wherein the housing is secured to a main body housing by the interaction of posts with securing openings formed on the housing.

8. The electrical connector of claim 7 wherein a second mating contact extends from the main body housing into the female contact to electrically engage the second protrusion.

* * * * *